US011166095B2

(12) United States Patent
Morris

(10) Patent No.: US 11,166,095 B2
(45) Date of Patent: Nov. 2, 2021

(54) HEADPHONE SPEAKER SYSTEM WITH INNER-EAR AND OVER-THE-EAR SPEAKERS

(71) Applicant: TAM Audio LLC, Trumbull, CT (US)

(72) Inventor: Trevor Morris, Trumbull, CT (US)

(73) Assignee: TAM AUDIO LLC, Trumbull, CT (US)

( * ) Notice: Subject to any disclaimer, the term of this patent is extended or adjusted under 35 U.S.C. 154(b) by 0 days.

(21) Appl. No.: 16/980,291

(22) PCT Filed: Feb. 28, 2019

(86) PCT No.: PCT/US2019/020012

§ 371 (c)(1),
(2) Date: Sep. 11, 2020

(87) PCT Pub. No.: WO2019/177782

PCT Pub. Date: Sep. 19, 2019

(65) Prior Publication Data

US 2021/0058696 A1 Feb. 25, 2021

Related U.S. Application Data

(60) Provisional application No. 62/642,275, filed on Mar. 13, 2018.

(51) Int. Cl.
*H04R 1/10* (2006.01)
*H04R 5/033* (2006.01)

(52) U.S. Cl.
CPC ..... *H04R 1/1075* (2013.01); *H04R 5/033* (2013.01); *H04R 2201/107* (2013.01);
(Continued)

(58) Field of Classification Search
CPC ..... H04R 1/1075; H04R 5/033; H04R 2201/107; H04R 2205/022; H04R 2205/024; H04R 2420/07
See application file for complete search history.

(56) References Cited

U.S. PATENT DOCUMENTS 3,984,885 A 10/1976 Yoshimura et al.
5,333,206 A 7/1994 Koss
(Continued)

FOREIGN PATENT DOCUMENTS

CN 102595266 A 7/2012
WO 99/39546 A1 8/1999

OTHER PUBLICATIONS

International Search Report and Written Opinion issued in corresponding International Application No. PCT/US2019/020012 dated Feb. 28, 2019.
(Continued)

*Primary Examiner* — Andrew L Sniezek
(74) *Attorney, Agent, or Firm* — Pillsbury Winthrop Shaw Pittman LLP

(57) ABSTRACT

A headphone speaker system includes over-the-ear speakers (left and right) and inner-ear speakers (left and right). The left over-the-ear speaker and the right over-the-ear speaker are configured to receive a left surround audio channel of an audio signal and a right surround audio channel of the audio signal, respectively, from a surround sound processor, and are configured to be positioned outside a left ear canal of a user and outside a right ear canal of the user, respectively. The left inner-ear speaker and the right inner-ear speaker are configured to receive a left front audio channel of the audio signal and a right front audio channel of the audio signal, respectively, from the surround sound processor, and are configured to be positioned at least partially within the left ear canal of the user and at least partially within the right ear canal of the user, respectively.

27 Claims, 9 Drawing Sheets

(52) U.S. Cl.
CPC .. *H04R 2205/022* (2013.01); *H04R 2205/024* (2013.01); *H04R 2420/07* (2013.01)

(56) References Cited

U.S. PATENT DOCUMENTS

| | | | | |
|---|---|---|---|---|
| 2017/0208380 | A1 | 7/2017 | Slater et al. | |
| 2020/0252721 | A1* | 8/2020 | Alexander | H04R 3/04 |

OTHER PUBLICATIONS

International Preliminary Report on Patentability issued in corresponding International Application No. PCT/US2019/020012 dated Sep. 24, 2020 (6 pages).

* cited by examiner

Headphone speaker system 106/116

Headphone speaker system 106/116

HEADPHONE SPEAKER SYSTEM WITH INNER-EAR AND OVER-THE-EAR SPEAKERS

CROSS-REFERENCE TO RELATED APPLICATIONS

This application claims priority to U.S. Provisional Patent Application No. 62/642,275, filed Mar. 13, 2018, which is expressly incorporated by reference in its entirety and assigned to the assignee hereof.

FIELD OF THE INVENTION

The invention relates to headphone speaker systems.

BACKGROUND OF THE INVENTION

Traditional headphones use an array of speakers embedded in an over-the-ear headset that are typically all the same distance from a user's ear canal and user's ear drum. Other traditional headphones have speaker systems that have at least a portion thereof that extend into the ear canal of the user. However, these systems, and any attempts to combine them, have achieved limited effects on the user experience.

SUMMARY OF THE INVENTION

Aspects of the invention relate to a headphone speaker system that includes inner-ear and over-the-ear speakers and a method of receiving audio channels by the inner-ear and over-the-ear speakers and outputting audio sounds (generated based on the audio channels) via the inner-ear and over-the-ear speakers.

One aspect of the disclosure relates to a headphone speaker system that includes inner-ear and over-the-ear speakers for achieving true surround sound effect. The inner-ear speakers receive front audio channels and are configured to be positioned at least partially within an ear canal of a user and the over-the-ear speakers receive surround sound channels and are configured to be positioned outside the ear canal of the user. Such a headphone speaker system achieves true surround sound effect.

Another aspect of the disclosure relates to a headphone speaker system that includes inner-ear speakers, over-the-ear speakers, and one or more surround sound processors. The one or more surround sound processors are configured to receive an audio signal, the inner-ear speakers receive front audio channels from the one or more surround sound processors and are configured to be positioned at least partially within an ear canal of a user, and the over-the-ear speakers receive surround sound channels from the one or more surround sound processors and are configured to be positioned outside the ear canal of the user. Such a headphone speaker system achieves true surround sound effect.

Another aspect of the disclosure relates to a method of receiving audio channels by a headphone speaker system. The method may include receiving surround sound audio channels by over-the-ear speakers that are configured to be positioned outside an ear canal of a user, and receiving front audio channels by the inner-ear-speaker that are configured to be positioned at least partially with the ear canal of the user. Such reception of audio channels via the over-the-ear speakers and the inner-ear speakers (and further outputting of sound based on the received audio channels) achieves true surround sound effect.

Various other aspects, features, and advantages of the invention will be apparent through the detailed description of the invention and the drawings attached hereto. It is also to be understood that both the foregoing general description and the following detailed description are exemplary and not restrictive of the scope of the invention. As used in the specification and in the claims, the singular forms of "a," "an," and "the" include plural referents unless the context clearly dictates otherwise. In addition, as used in the specification and the claims, the term "or" means "and/or" unless the context clearly dictates otherwise.

DETAILED DESCRIPTION OF THE INVENTION

In the following description, for the purposes of explanation, numerous specific details are set forth in order to provide a thorough understanding of the embodiments of the invention. It will be appreciated, however, by those having skill in the art that the embodiments of the invention may be practiced without these specific details or with an equivalent arrangement. In other instances, well-known structures and devices are illustrated in block diagram form in order to avoid unnecessarily obscuring the embodiments of the invention.

Figure 1A:
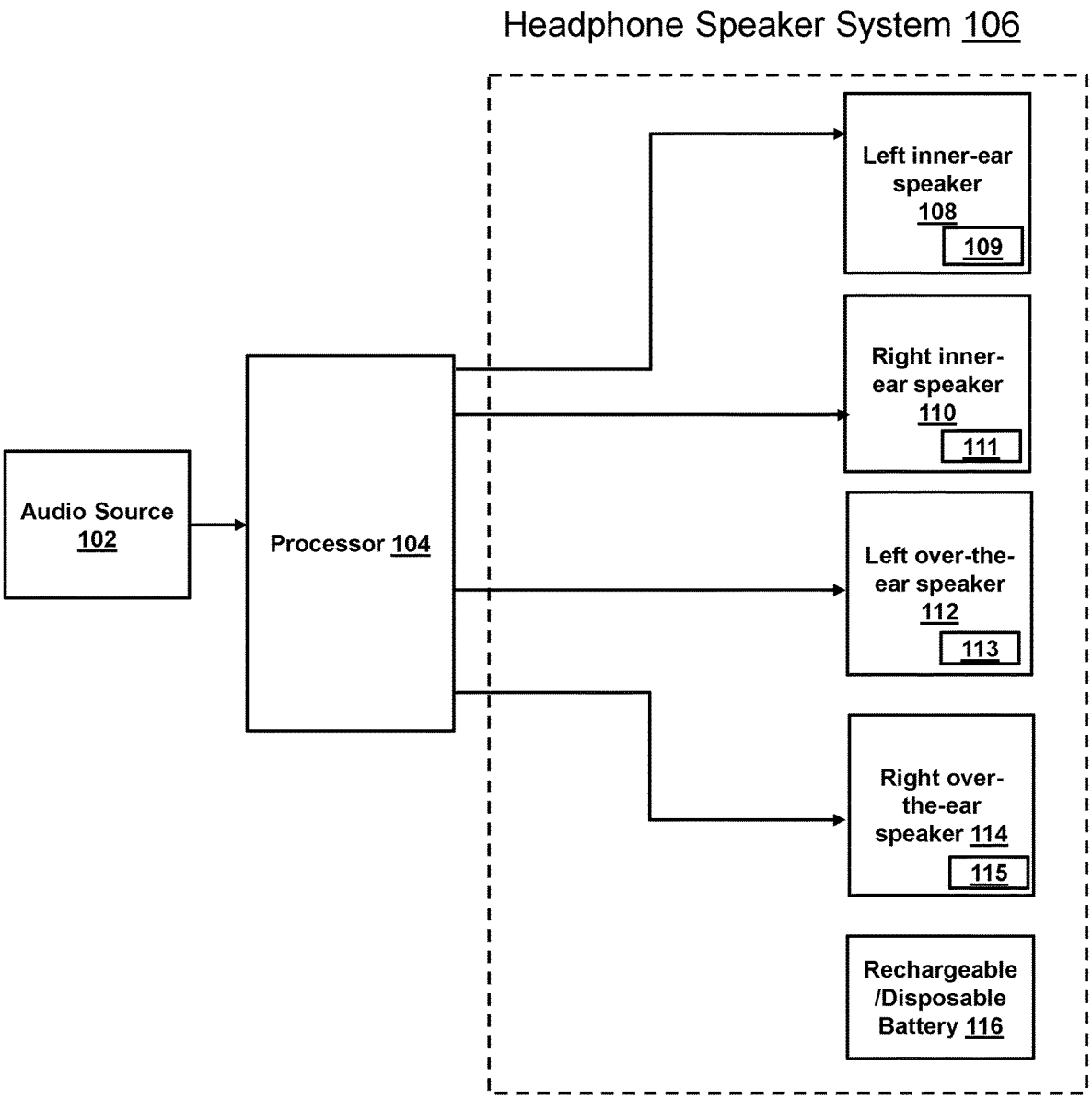
FIG. 1A illustrates an exemplary embodiment of an audio system including a headphone speaker system, a processor, and an audio source.

FIG. 1A illustrates an audio system that includes an audio source 102, a processor 104, and a headphone speaker system 106. The headphone speaker system 106 includes a left inner-ear speaker 108, a right inner-ear speaker 110, a left over-the-ear speaker 112, and a right over-the-ear speaker 114 (for example, the over-the-ear speakers are larger than the inner-ear speakers). Although only a single left inner-ear speaker 108, a single right inner-ear speaker 110, a single left over-the-ear speaker 112, and a single right over-the-ear speaker 114 are illustrated in FIG. 1A, it should be understood that the headphone speaker system 106 can include a plurality of left inner-ear speakers 108, a plurality of right inner-ear speakers 110, a plurality of left over-the-ear speakers 112, and a plurality of right over-the-ear speakers 114. Further, the system can include a plurality of audio sources 102 and a plurality of processors 104.

The audio source 102 provides audio signals to the processor 104. The audio signal may include one or more of the following audio channels: a left surround audio channel, a right surround audio channel, a left front audio channel, a right front audio channel, a left center audio channel, a right center audio channel, a left subwoofer audio channel, and a right subwoofer audio channel. The audio channels received by the processor 104 are not limited to the ones mentioned above, and can include any other audio channel.

The processor 104 (for example, a multi-channel soundcard like the Creative Soundblaster Omni HD 5.1 or any surround sound processor) receives the audio signals and separates the audio signals into a plurality of audio channels (or components). For example, when the processor 104 receives an audio signal from the audio source 102, the processor 104 may separate the audio signal into the following audio channels: a left surround audio channel, a right surround audio channel, a left front audio channel, a right front audio channel, a left center audio channel, a right center audio channel, a left subwoofer audio channel, and a right subwoofer audio channel. Once the audio channels are separated by the processor 104, these separated audio channels are transmitted to the left inner-ear speaker 108, right inner-ear speaker 110, left over-the-ear speaker 112, and right over-the-ear speaker 114. For example, the left inner-ear speaker 108 may receive the left front audio channel, the right inner-ear speaker 110 may receive the right front audio channel, the left over-the-ear speaker 112 may receive the left surround audio channel, and the right over-the-ear speaker 114 may receive the right surround audio channel. Further, the left inner-ear speaker 108 and the right inner-ear speaker 110 may also receive the left center audio channel and the right center audio channel, respectively, and the left over-the-ear speaker 112 and right over-the-ear speaker 114 may also receive a left subwoofer audio channel and a right subwoofer audio channel, respectively. If the audio signal from the audio source 102 does not include a plurality of audio channels, a single audio channel can be received by the left inner-ear speaker 108, right inner-ear speaker 110, left over-the-ear speaker 112, and right over-the-ear speaker 114 to generate sounds from these speakers.

Each of the speakers illustrated in FIG. 1A (i.e., the left inner-ear speaker 108, right inner-ear speaker 110, left over-the-ear speaker 112, and right over-the-ear speaker 114) may include one or more drivers 109, 111, 113, and 115 that convert the received audio channels (for example, a left surround audio channel, a right surround audio channel, a left front audio channel, a right front audio channel, a left center audio channel, a right center audio channel, a left subwoofer audio channel, and a right subwoofer audio channel) into one or more audible sounds. For example, the left over-the-ear speaker 112 generates a left surround sound by converting the left surround audio channel into the left surround sound, the right over-the-ear speaker 114 generates a right surround sound by converting the right surround audio channel into the right surround sound, the left inner-ear speaker 108 generates a left front sound by converting the left front audio channel into the left front sound, and the right inner-ear speaker 110 generates a right front sound by converting the right front audio channel into the right front sound. Further, for example, the left inner-ear speaker 108 generates a left center sound by converting the left center audio channel into the left center sound, the right inner-ear speaker 110 generates a right center sound by converting the right center audio channel into the right center sound, the left over-the-ear speaker 112 generates a left subwoofer sound by converting the left subwoofer audio channel, and the right over-the-ear speaker 114 generates a right subwoofer sound by converting the right subwoofer audio channel. Since the over-the-ear speakers 112 and 114 are larger than the inner-ear speakers 108 and 110, the over-the-ear speakers 112 and 114 can deliver low-frequency energy (for example, subwoofer sounds) more efficiently than the inner-ear speakers 108 and 110. Further, stereo playback may be played primarily via the inner-ear speakers 108 and 110. With the addition of the processor 104 (for example, within the headphone speaker system 116 in FIG. 1B), a room or acoustic space could be simulated and the reverberation effects could be played via the over-the-ear speakers 112 and 114.

The different speakers described above (i.e., the left inner-ear speaker 108, right inner-ear speaker 110, left over-the-ear speaker 112, and right over-the-ear speaker 114) may be included in different portions of the headphone speaker system 106. For example, the left over-the-ear speaker 112 may be included in a left over-the-ear portion (for example, see left over-the-ear portion 208 in FIGS. 2A-2F) of the headphone speaker system 106 so that the left over-the-ear speaker 112 is positioned outside a left ear canal of a user (for example, over the left pinnae of the user) using the headphone speaker system 106, the right over-the-ear speaker 114 may be included in a right over-the-ear portion (for example, see right over-the-ear portion 202 in FIGS. 2A-2F) of the headphone speaker system 106 so that the right over-the-ear speaker 114 is positioned outside a right ear canal of the user (for example, over the right pinnae of the user) using the headphone speaker system 106, the left inner-ear speaker 108 may be included in a left inner-ear portion (for example, see left inner-ear portion 206 in FIGS. 2A-2D and 2F) of the headphone speaker system 106 so that the left inner-ear speaker 108 is positioned at least partially within the left ear canal of the user using the headphone speaker system 106, and the right inner-ear speaker 110 may be included in a right inner-ear portion (for example, see right inner-ear portion 204 in FIGS. 2A-2E) of the headphone speaker system 106 so that the right inner-ear speaker 110 is positioned at least partially within the right ear canal of the user using the headphone speaker system 106.

Positioning of the right inner-ear speaker 110 and the left inner-ear speaker 108 at least partially within the ear canal of the user allows for sounds that occur in front of the user to sound more present in the user's sense of the virtual environment. Positioning the right over-the-ear speaker 114 and the left over-the-ear speaker 112 outside the ear canal of the user provides the user with a surround/environmental effect (which can be lowered and raised in volume by the user) that sounds to the user as a more sonically distant, separate effect compared to the sounds from the right inner-ear speaker 110 and the left inner-ear speaker 108. For example, if the left over-the-ear and right over-the-ear speakers 112 and 114 are positioned (for example, outside the ear canal of the user) 6 mm away from the ear drum of the user and the right inner-ear and left inner-ear speakers 110 and 108 are positioned (for example, at least partially within the ear canal of the user) 3 mm away from the ear drum of the user, and if the same sound is played in the right inner-ear and left inner-ear speakers 110 and 108 and then in the left over-the-ear and right over-the-ear speakers 112 and 114 at the same output pressure level (volume), the user would feel that the sound is twice as loud (under the principle of inverse-square law) when played out of the right inner-ear and left inner-ear speakers 110 and 108 (compared to the left over-the-ear and right over-the-ear speakers 112 and 114) even though the output level is kept the same. Such separation in distance of the inner-ear speakers (i.e., the right inner-ear the left inner-ear speakers 110 and 108) and over-the-ear speakers (i.e., the left over-the-ear and right over-the-ear speakers 112 and 114) from the ear drum of the user allows the sounds in front of the user to be louder than the sounds surrounding the user.

The over-the-ear speakers (i.e., the left over-the-ear speaker 112 and the right over-the-ear speaker 114) being a greater distance away from the user's ear canal provides a separation point due to the fact that the over-the-ear speakers (i.e., the left over-the-ear speaker 112 and the right over-the-ear speaker 114) interact with the pinnae (ear lobes) of the user, which causes the user to think of these sounds (i.e., from the left over-the-ear speaker 112 and the right over-the-ear speaker 114) as being farther away from the ear due to loudness and time-of-flight of the sounds (if the same sound is played though the inner-ear speakers and the over-the-ear speakers simultaneously). A typical listener will experience a more ambient, natural effect of the virtual environment that they are in due to the positioning of the inner-ear speakers (i.e., the left inner-ear speaker 108 and right inner-ear speaker 110) and over-the-ear speakers (i.e., the left over-the-ear speaker 112 and the right over-the-ear speaker 114) in the headphone speaker system 106. The positioning of the inner-ear speakers and the over-the-ear speakers will have a psychoacoustic effect due to the difference in distances of the inner-ear speakers and the over-the-ear speakers from the user's ear canal and user's ear drum. Further, the positioning of the inner-ear speakers allows for a more natural effect for sounds in front of the user as they would in the real world. As the sounds from the inner-ear speakers and the over-the-ear speakers are not coming from exactly the same plane as in standard headphones, a user's brain interprets these sounds as two sources depending on the audio playback.

In addition to the positioning of the inner-ear speakers (i.e., the left inner-ear speaker 108 and right inner-ear speaker 110) and over-the-ear speakers (i.e., the left over-the-ear speaker 112 and the right over-the-ear speaker 114) within the inner-ear portions (i.e., the left inner-ear portion 206 and the right inner-ear portion 204 in FIGS. 2A-2F) and over-the-ear portions (i.e., the left over-the-ear portion 208 and the right over-the-ear portion 202), respectively, of the headphone speaker system 106, the inner-ear speakers (i.e., the left inner-ear speaker 108 and right inner-ear speaker 110) and over-the-ear speakers (i.e., the left over-the-ear speaker 112 and the right over-the-ear speaker 114) are oriented such that they output sounds aimed directly towards a user's ear canal when the user wears the headphone speaker system 106. The inner-ear speakers (i.e., the left inner-ear speaker 108 and right inner-ear speaker 110) include one or more openings that allow sounds from the over-the-ear speakers (i.e., the left over-the-ear speaker 112 and the right over-the-ear speaker 114) to pass through. The one or more openings also allow sounds from inside the inner-ear speakers (i.e., the left inner-ear speaker 108 and right inner-ear speaker 110) to pass through to the over-the-ear speakers (i.e., the left over-the-ear speaker 112 and the right over-the-ear speaker 114).

The headphone speaker system 106 may include a rechargeable or disposable battery 116 within the headphone speaker system 106 that provides power for the inner-ear speakers (i.e., the left inner-ear speaker 108 and right inner-ear speaker 110) and over-the-ear speakers (i.e., the left over-the-ear speaker 112 and the right over-the-ear speaker 114). In case the processor 104 is within the headphone speaker system (see embodiment in FIG. 1B), the rechargeable or disposable battery 116 may also provide power for the processor 104.

Further, the processor 104 may adjust (for example, in response to a user input) the audio signals that it receives from the audio source 102. For example, the processor 104 may adjust (for example, in response to a user input) the gain for multiple frequencies of the audio signals to accommodate differences in the user's hearing and/or differences in the drivers being used by the inner-ear and over-the-ear speakers. The goal is to tune the drivers to have near-identical frequency responses and this goal can be achieved by having the processor 104 adjust (for example, in response to a user input) the gain for multiple frequencies of the audio signals to accommodate differences in the drivers being used by the inner-ear and over-the-ear speakers. The processor 104 may also delay the output of the left front audio channel, right front audio channel, right center audio channel, and the left center audio channel from the processor 104 to the inner-ear speakers (i.e., the left inner-ear speaker 108 and right inner-ear speaker 110) by a predetermined amount such that the user's ear simultaneously receives the sounds from the inner-ear and over-the-ear speakers. The predetermined amount of delay may be based on distances between the left over-the-ear speaker and the left inner-ear speaker and between the right over-the-ear speaker and the right inner-ear speaker. The predetermined amount of delay may be to accommodate the distance of each speaker from the user's ear so that the over-the-ear speakers can convert the audio channels into sound without having to worry about the distance of the over-the-ear speakers from the user's ear.

The audio source 102, the processor 104, and the headphone speaker system 106 may be connected via a wired connection, a wireless connection, or a hybrid of the wired and wireless connections (e.g., ⅛" connectors, WiFi, Bluetooth, HDMI, USB, USB-C, USB dongle, or other technologies).

The audio source 102 may include any type of mobile terminal, fixed terminal, or other device. By way of example, the audio source 102 may include a desktop computer, a notebook computer, a tablet computer, a smartphone, a wearable device, an mp3 player, a television, a gaming console, or other audio sources. Further, the processor 104 may be a surround sound processor (for example, a multi-channel soundcard like the Creative Soundblaster Omni HD 5.1). The processor 104 may be programmed to provide information processing capabilities. As such, the processor 104 may include one or more of a digital processor, an analog processor, a digital circuit designed to process information, an analog circuit designed to process information, a state machine, and/or other mechanisms for electronically processing information. In some embodiments, the processor 104 may include a plurality of processing units. These processing units may be physically located within the same device, or the processors may represent processing functionality of a plurality of devices operating in coordination. The processor 104 may be programmed to execute computer program instructions by software; hardware; firmware; some combination of software, hardware, or firmware; and/or other mechanisms for configuring processing capabilities on the processor 104.

The headphone speaker system 106 may include over-the-ear portions 208 and 202 (see FIGS. 2A-2F) that include the over-the-ear speakers (i.e., the left over-the-ear speaker 112 and right over-the-ear speaker 114) and inner-ear portions 206 and 204 (see FIGS. 2A-2F) that include the inner-ear speakers (i.e., the left inner-ear speaker 108 and right inner-ear speaker 110). The description of the headphone speaker system 106 is provided in more detail with regard to FIGS. 2A-2F.

The audio source 102 and the headphone speaker system 106 may include one or more electronic storages, one or more physical processors programmed with one or more computer program instructions, and/or other components. The one or more physical processors may be programmed to provide information processing capabilities. As such, the one or more physical processors may include one or more of a digital processor, an analog processor, a digital circuit designed to process information, an analog circuit designed to process information, a state machine, and/or other mechanisms for electronically processing information. In some embodiments, the one or more physical processors may include a plurality of processing units. These processing units may be physically located within the same device, or the processors may represent processing functionality of a plurality of devices operating in coordination. The one or more physical processors may be programmed to execute computer program instructions by software; hardware; firmware; some combination of software, hardware, or firmware; and/or other mechanisms for configuring processing capabilities on the one or more physical processors. The electronic storages may include non-transitory storage media that electronically stores information. The electronic storage media of the electronic storages may include one or both of (i) system storage that is provided integrally (e.g., substantially non-removable) with servers or client devices or (ii) removable storage that is removably connectable to the servers or client devices via, for example, a port (e.g., a USB port, a firewire port, etc.) or a drive (e.g., a disk drive, etc.). The electronic storages may include one or more of optically readable storage media (e.g., optical disks, etc.), magnetically readable storage media (e.g., magnetic tape, magnetic hard drive, floppy drive, etc.), electrical charge-based storage media (e.g., EEPROM, RAM, etc.), solid-state storage media (e.g., flash drive, etc.), and/or other electronically readable storage media. The electronic storages may include one or more virtual storage resources (e.g., cloud storage, a virtual private network, and/or other virtual storage resources). The electronic storage may store software algorithms, information determined by the processors, information obtained from servers, information obtained from client devices, or other information that enables the functionality as described herein.

Figure 1B:
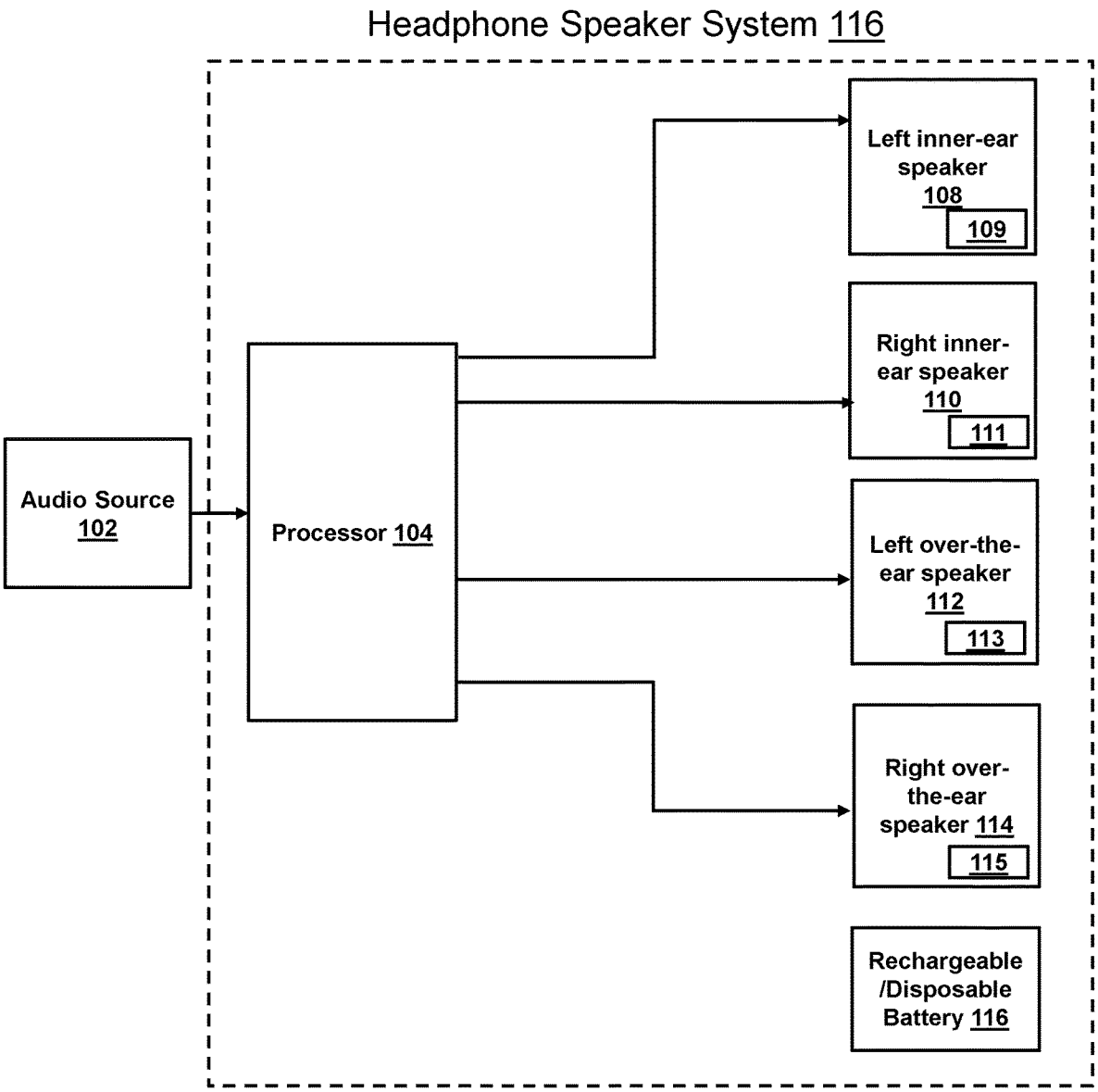
FIG. 1B illustrates an exemplary embodiment of an audio system including a headphone speaker system and an audio source.

FIG. 1B illustrates an audio system that includes an audio source 102 and a headphone speaker system 116. In this exemplary embodiment, the processor 104 is located inside the headphone speaker system 116 (as opposed to being located outside the headphone speaker system 106 in FIG. 1A). Other than the location of the processor 104 in FIG. 1B, all the details provided above with regard to FIG. 1A also apply to FIG. 1B. Accordingly, for the sake of brevity, the details are not repeated.

FIGS. 2A-2F illustrate a headphone speaker system 106/116 that includes a left over-the-ear portion 208, a right over-the-ear portion 202, a left inner-ear portion 206, a right inner-ear portion 204, a connector portion 210, cables 212, 214, and 216, hinges 240 and 242, chambers 246 and 248, recessed areas 250 and 252, and microphone 244.

Figure 2A:
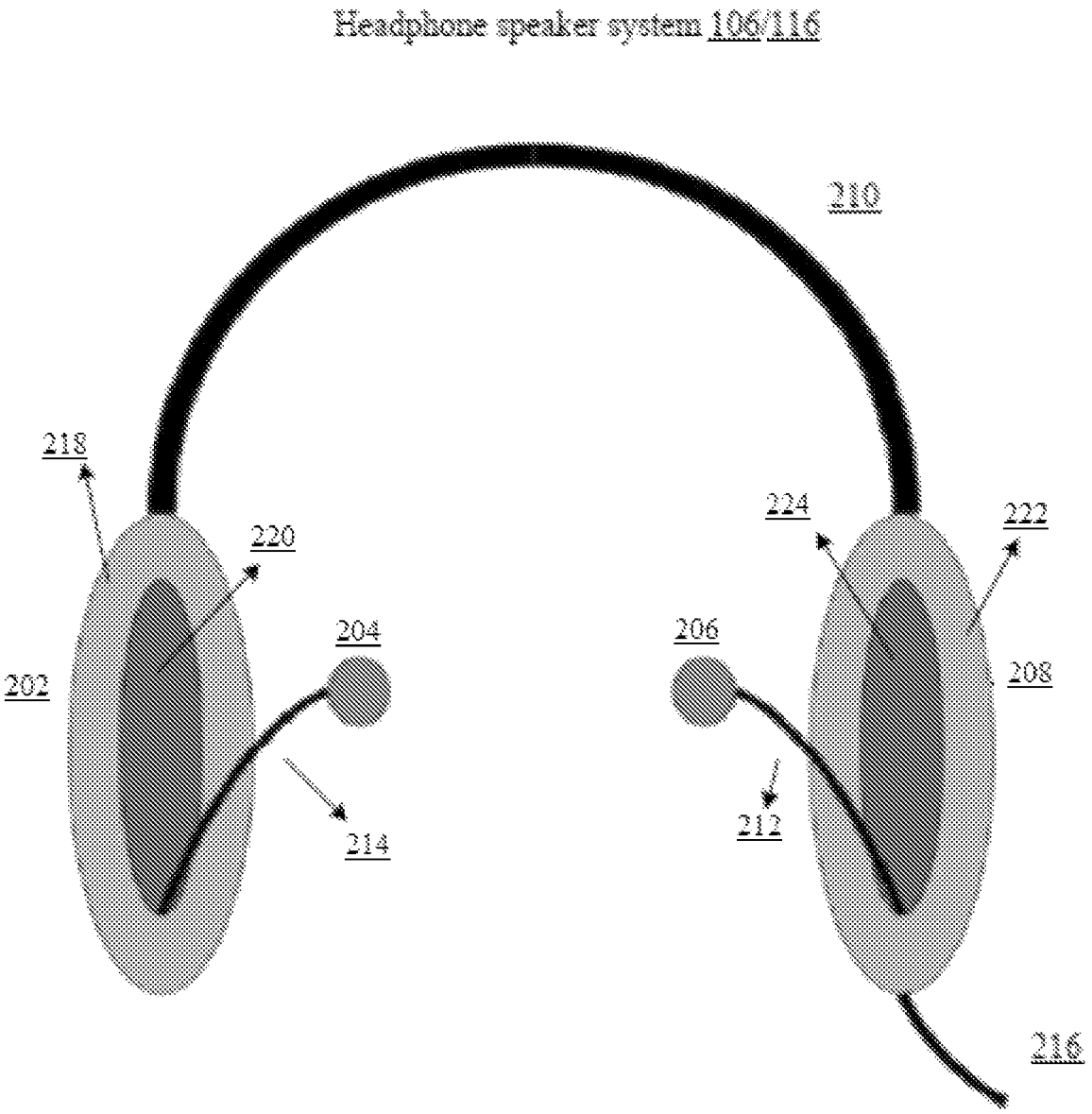
FIGS. 2A, 2B, 2C, 2D, 2E, and 2F illustrate exemplary embodiments of a headphone speaker system.
Figure 2B:
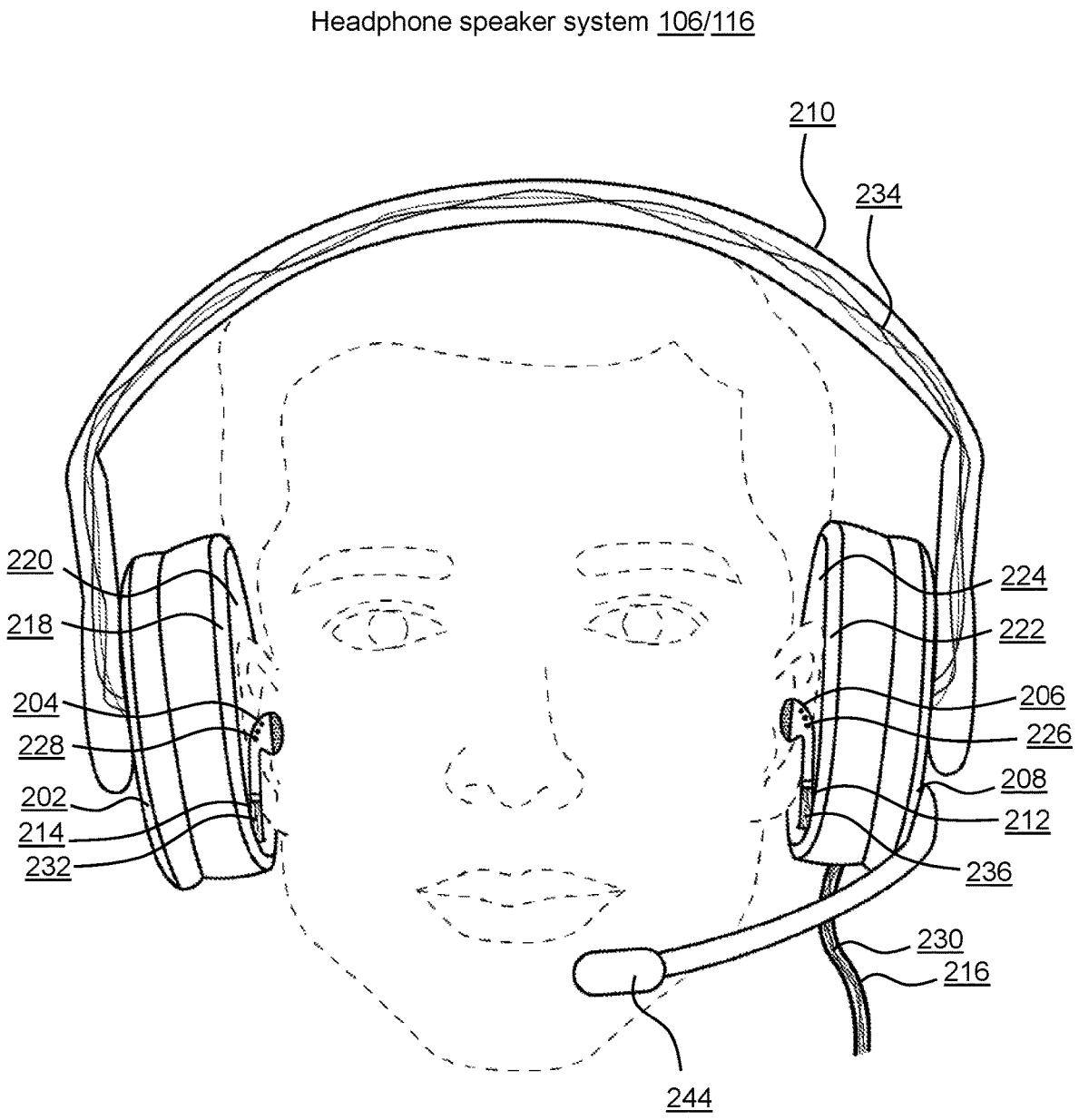
Figure 2C:
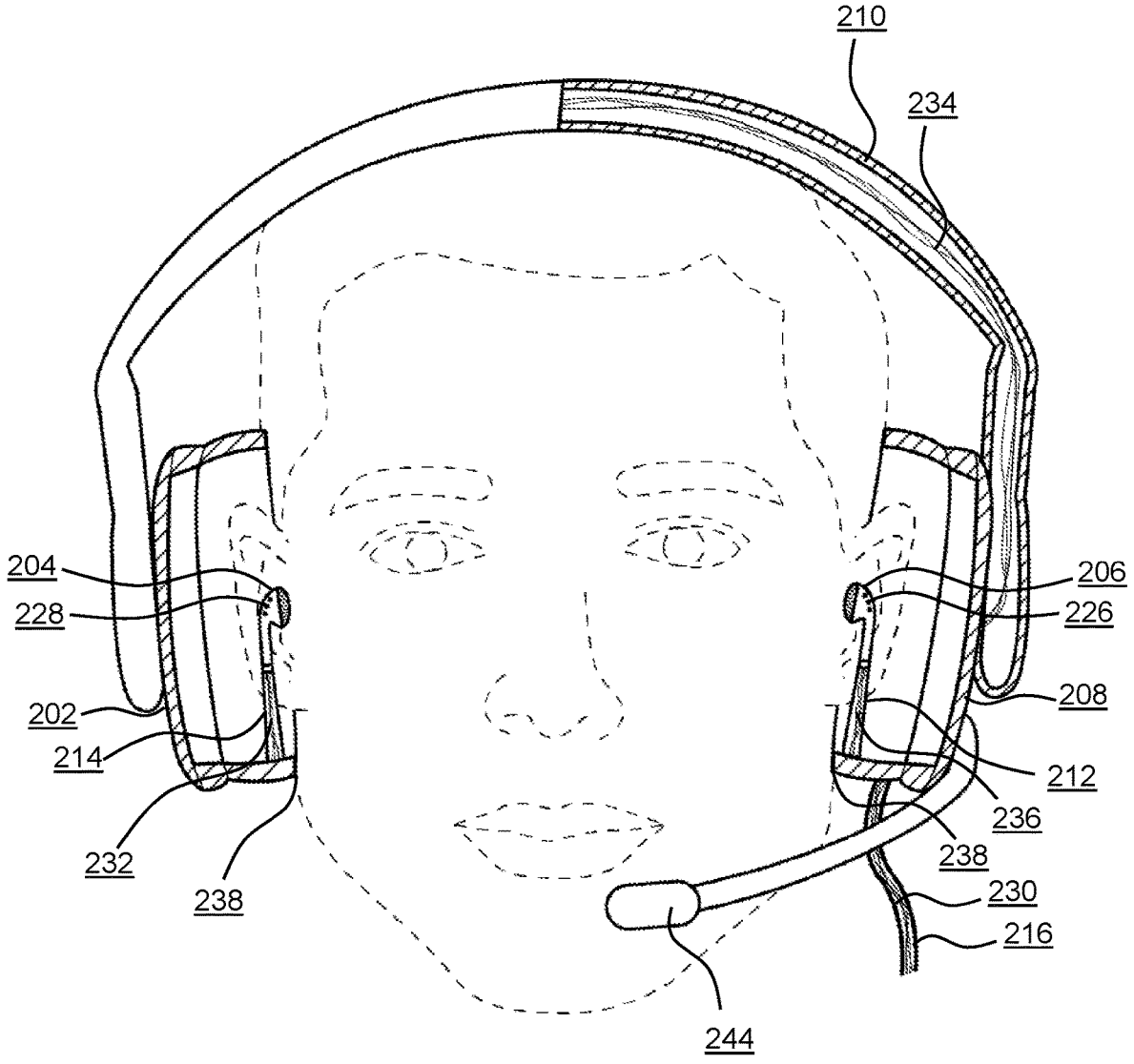
Figure 2D:
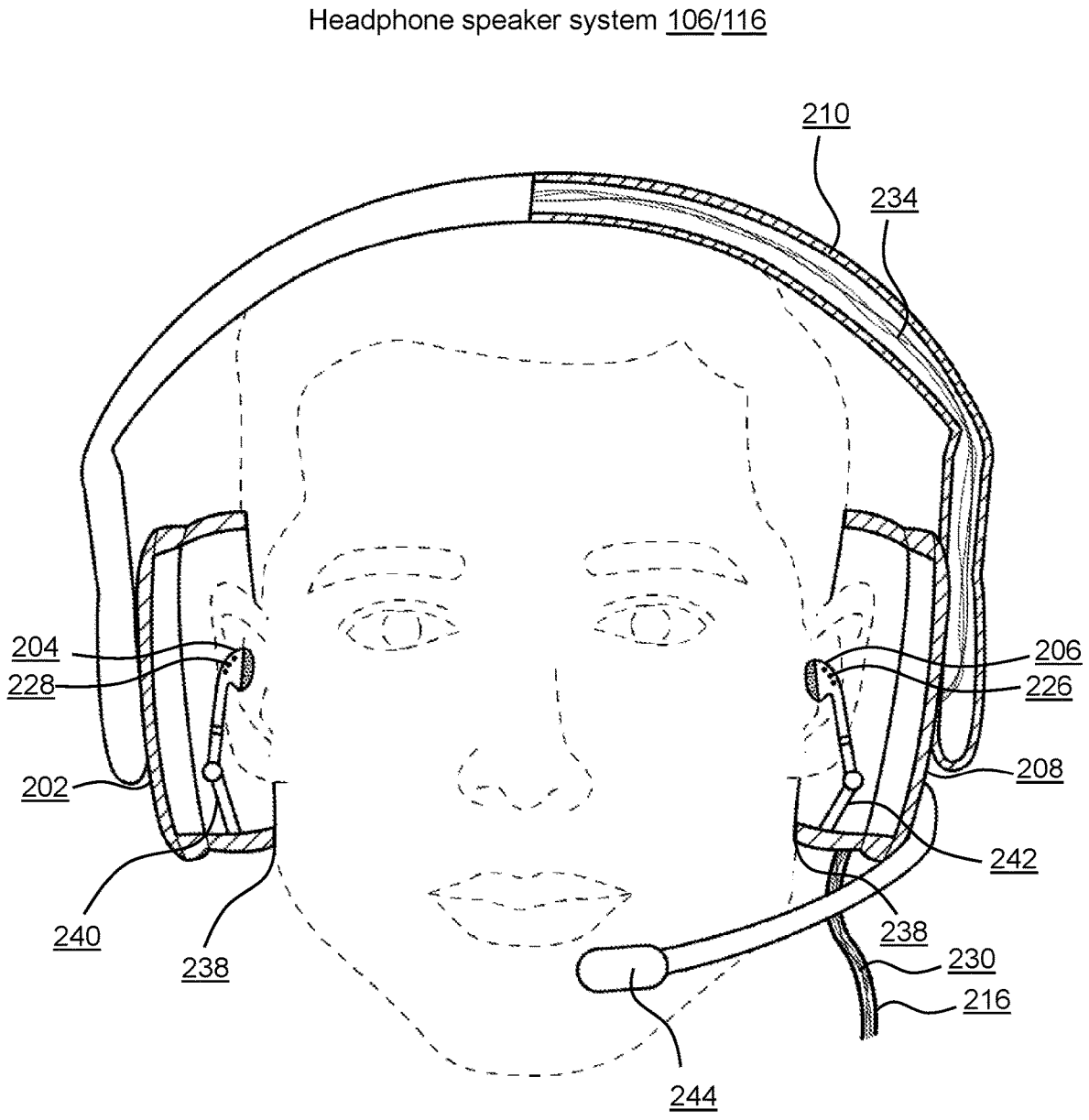
Figure 2E:
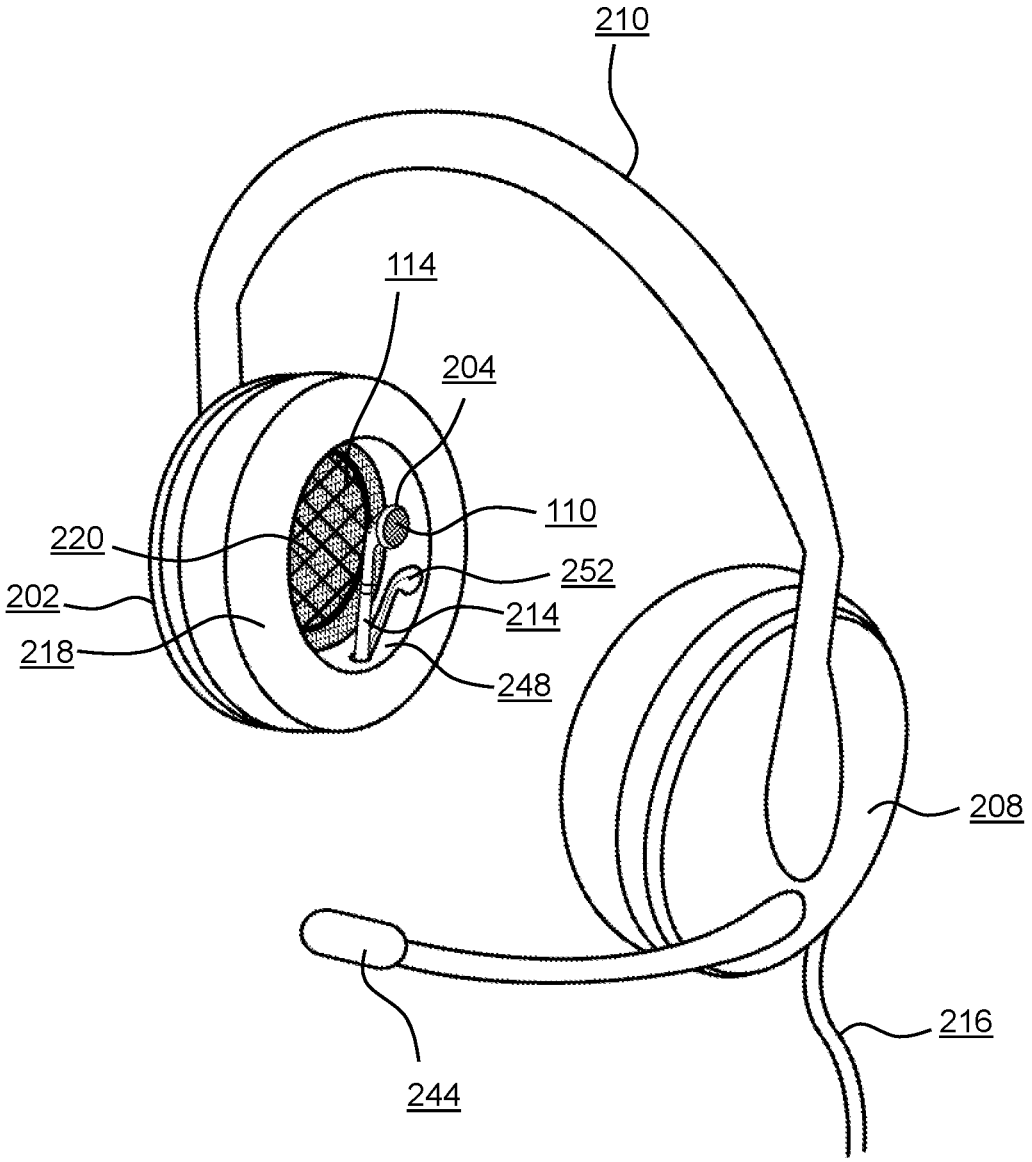
Figure 2F:
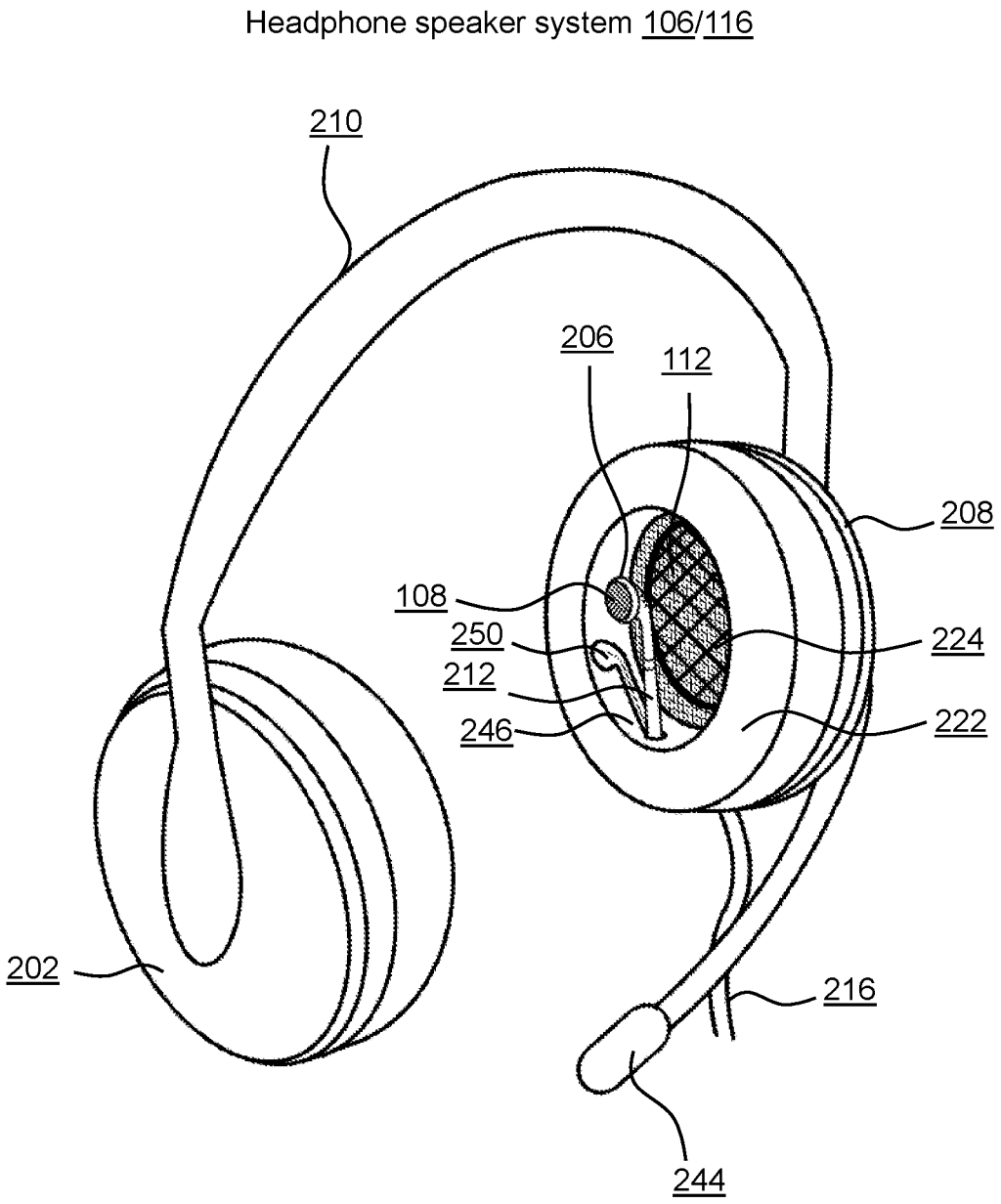

The left over-the-ear portion 208 may house one or more of the left over-the-ear speakers 112, the right over-the-ear portion 202 may house one or more of the right over-the-ear speakers 114, the left inner-ear portion 206 may house one or more of the left inner-ear speakers 108, and the right inner-ear portion 204 may house one or more of the right inner-ear speakers 110 (see FIGS. 2E and 2F).

Further, the left over-the-ear portion 208 may include a left outer annular portion 222 and a left inner annular portion 224 that is surrounded by the left outer annular portion 222 (see FIGS. 2A, 2B, and 2F). A chamber 246 (see FIG. 2F) may be formed within the left over-the-ear portion 208 (for example, between the left inner annular portion 224 and the left outer annular portion 222) and the sounds produced by the left over-the-ear speaker 112 and left inner-ear speaker 108 may reverberate within the chamber 246 before reaching the user's ear canal. A user's ear may be positioned within the chamber 246 when the headphone system 106/116 is used by the user. The left outer annular portion 222 may correspond to a cushion that is made of foam, elastic, rubber, or other resilient interior material and has a soft leather, plastic, or other soft material cover. The cushion may provide comfort to a user when worn and may help partially or completely block outside noises from entering the user's ear. The right and left over-the-ear portions 202 and 208 (for example, the right outer annular portion 218 and the left outer annular portion 222) may form a seal 238 (see FIGS. 2C and 2D) against the user's head so as to substantially (or completely) eliminate external sound from entering the right and left over-the-ear portions 202 and 208 (thereby eliminating external sound from entering the user's ears). The headphone speaker system 106/116 may be noise canceling such that the only sounds that pass through the inner-ear portions 206 and 204 to the user's ears are the sounds produced by the left over-the-ear speaker 112 and right over-the-ear speaker 114 (and the sounds produced by the left inner-ear speaker 108 and right inner-ear speaker 110 that may bounce off the user's ears, portions of the chamber 246 within the left over-the ear portion 208, and portions of the chamber 248 within the right over-the-ear portion 202). The sounds produced by the left over-the-ear speaker 112 and right over-the-ear speaker 114 may also bounce off the user's ear, portions of the chamber 246 within the left over-the ear portion 208, and portions of the chamber 248 within the right over-the-ear portion 202. The cushion may be configured such that the left over-the-ear portion 208 may cup the user's ear or rest on top of the user's ear. Alternatively, the left outer annular portion 222 may correspond to a hard cover that may be made of plastic (or metal) and that is configured to rest on top of the user's ear. The left inner annular portion 224 may correspond to a thin/soft layer (for example, cloth, leather, or any material suitable to pass sound therethrough) that includes holes to allow the sound from the left over-the-ear speaker 112 (which is housed within the left over-the-ear portion 208) to pass through. Alternatively, the left inner annular portion 224 may correspond to a hard cover that may be made of plastic (or metal) and that includes holes to allow the sound from the left-over-the ear speaker 112 (which is housed within the left over-the-ear portion 208) to pass through. The left outer annular portion 222 may also include holes to allow the sound from the left over-the-ear speaker 112 (which is housed within the left over-the-ear portion 208) to pass through.

Similarly, the right over-the-ear portion 202 may include a right outer annular portion 218 and a right inner annular portion 220 that is surrounded by the right outer annular portion 218 (see FIGS. 2A, 2B, and 2E). A chamber 248 (see FIG. 2E) may be formed within the right over-the-ear portion 202 (for example, between the right inner annular portion 220 and the right outer annular portion 218) and the sounds produced by the right over-the-ear speaker 114 and right inner-ear speaker 110 may reverberate within the chamber 248 before reaching the user's ear canal. A user's ear may be positioned within the chamber 248 when the headphone system 106/116 is used by the user. The right outer annular portion 218 may correspond to a cushion that is made of foam, elastic, rubber, or other resilient interior material and has a soft leather, plastic, or other soft material cover. The cushion may provide comfort to a user when worn and may help partially or completely block outside noises from entering the user's ear. The right and left over-the-ear portions 202 and 208 (for example, the right outer annular portion 218 and the left outer annular portion 222) may form a seal 238 (see FIGS. 2C and 2D) against the user's head so as to substantially (or completely) eliminate external sound from entering the right and left over-the-ear portions 202 and 208 (thereby eliminating external sound from entering the user's ears). The headphone speaker system 106/116 may be noise canceling such that the only sounds that pass through the inner-ear portions 206 and 204 to the user's ears are the sounds produced by the left over-the-ear speaker 112 and right over-the-ear speaker 114 (and the sounds produced by the left inner-ear speaker 108 and right inner-ear speaker 110 that may bounce off the user's ears, portions of the chamber 246 within the left over-the ear portion 208, and portions of the chamber 248 within the right over-the-ear portion 202). The sounds produced by the left over-the-ear speaker 112 and right over-the-ear speaker 114 may also bounce off the user's ear, portions of the chamber 246 within the left over-the ear portion 208, and portions of the chamber 248 within the right over-the-ear portion 202. The cushion may be configured such that the right over-the-ear portion 202 may cup the user's ear or rest on top of the user's ear. Alternatively, the right outer annular portion 218 may correspond to a hard cover that may be made of plastic (or metal) and that is configured to rest on top of the user's ear. The right inner annular portion 220 may correspond to a thin/soft layer (for example, cloth, leather, or any material suitable to pass sound therethrough) that includes holes to allow the sound from the right over-the-ear speaker 114 (which is housed within the right over-the-ear portion 202) to pass through. Alternatively, the right inner annular portion 220 may correspond to a hard cover that may be made of plastic (or metal) and that includes holes to allow the sound from the right-over-the ear speaker 114 (which is housed within the right over-the-ear portion 202) to pass through. The right outer annular portion 218 may also include holes to allow the sound from the right over-the-ear speaker 114 (which is housed within the right over-the-ear portion 202) to pass through.

The left over-the-ear portion 208 and the right over-the-ear portion 202 may also include additional hardware (for example, mini mixing board hardware) that may allow the user to manually pan and adjust gain and equalizer settings of the various audio signals that make their way into the headphone speaker system 106/116. Alternatively, such hardware may be included on the cable 216.

Further, an outer layer of the left inner-ear portion 206 may be made of a soft material (for example, cloth, foam, or any other soft material suitable to pass sound therethrough) that includes holes (for example, facing the user's ear canal) and holes 226 (for example, facing the left over-the-ear portion 208) to allow the sound from the left inner-ear speaker 108 (which is housed within the left inner-ear portion 206) and the sound from the left over-the-ear speaker 112 (which is housed within the left over-the-ear portion 208) to pass through. The outer layer of the left inner-ear portion 206 may be a resilient material (e.g., elastomeric or rubber) that can partially be inserted into the ear canal and resiliently deform and adapt to the shape of the ear canal. Alternatively, the outer layer of the left inner-ear portion 206 may be rigid and made of plastic (or metal) that includes holes (for example, facing the user's ear canal) and holes 226 (for example, facing the left over-the-ear portion 208) and holes 226 (for example, facing the left over-the-ear portion 208) that allow the sound from the left inner-ear speaker 108 (which is housed within the left inner-ear portion 206) and the sound from the left over-the-ear speaker 112 (which is housed within the left over-the-ear portion 208) to pass through. These holes 226 may be placed in hexagonal, octagonal, or other geometric layouts to optimize the passing of sound from the left over-the-ear speaker 112 to the user's ears (via the left inner-ear portion 206). Such holes 226 may optimize both the direct sound from the left over-the-ear speaker 112 to pass through to the user's ears (via the left inner-ear portion 206) and indirect sound (for example, sounds bouncing off the user's ear canal (or any portion of a user's ear) or any portion of the headphone speaker system) to pass through to the user's ears (via the left inner-ear portion 206). Alternatively, in some embodiments, the outer layer of the left inner-ear portion 206 may be made up of a combination of the above-noted materials.

Similarly, an outer layer of the right inner-ear portion 204 may be made of a soft material (for example, cloth, foam, or any other soft material suitable to pass sound therethrough) that includes holes (for example, facing the user's ear canal) and holes 228 (for example, facing the right over-the-ear portion 202) to allow the sound from the right inner-ear speaker 110 (which is housed within the right inner-ear portion 204) and the sound from the right over-the-ear speaker 114 (which is housed within the right over-the-ear portion 202) to pass through. The outer layer of the right inner-ear portion 204 may be a resilient material (e.g., elastomeric or rubber) that can partially be inserted into the ear canal and resiliently deform and adapt to the shape of the ear canal. Alternatively, the outer layer of the right inner-ear portion 204 may be rigid and made of plastic (or metal) that includes holes (for example, facing the user's ear canal) and holes 228 (for example, facing the right over-the-ear portion 202) that allow the sound from the right inner-ear speaker 110 (which is housed within the right inner-ear portion 204) and the sound from the right over-the-ear speaker 114 (which is housed within the right over-the-ear portion 202) to pass through. These holes 228 may be placed in hexagonal, octagonal, or other geometric layouts to optimize the passing of sound from the right over-the-ear speaker 114 to the user's ears (via the right inner-ear portion 204). Such holes 228 may optimize both the direct sound from the right over-the-ear speaker 114 to pass through to the user's ears (via the right inner-ear portion 204) and indirect sound (for example, sounds bouncing off the user's ear canal (or any portion of a user's ear) or any portion of the headphone speaker system) to pass through to the user's ears (via the right inner-ear portion 204). Alternatively, in some embodiments, the outer layer of the right inner-ear portion 204 may be made up of a combination of the above-noted materials.

When a user wears the headphone speaker system 106/116, the left over-the-ear portion 208 is configured to be positioned over the user's left ear canal (for example, the left over-the-ear portion 208 may cup the user's ear by totally surrounding the user's ear or may rest on top of the user's ear), the right over-the-ear portion 202 is configured to be positioned over the user's right ear canal (for example, the right over-the-ear portion 202 may cup the user's ear by totally surrounding the user's ear or may rest on top of the user's ear), the left inner-ear portion 206 is configured to be positioned at least partially within the user's left ear canal, and the right inner-ear portion 204 is configured to be positioned at least partially within the user's right ear canal.

Positioning of the left inner-ear portion 206 and the right inner-ear portion 204 at least partially within the ear canal of the user allows for sounds that occur in front of the user to sound more present in the user's sense of the virtual environment. Positioning the right over-the-ear portion 202 and the left over-the-ear portion 208 outside the ear canal of the user provides the user with a surround/environmental effect (which can be lowered and raised in volume by the user) that sounds to the user as a more sonically distant, separate effect compared to the sounds from the right inner-ear portion 204 and the left inner-ear portion 206. The separation in distance of the inner-ear portions (i.e., the left inner-ear portion 206 and the right inner-ear portion 204) and the over-the-ear portions (i.e., the left over-the-ear portion 208 and the right over-the-ear portion 202) from the ear drum of the user allows the sounds in front of the user to be louder than the sounds surrounding the user.

The over-the-ear portions (i.e., the left over-the-ear portion 208 and the right over-the-ear portion 202) being a greater distance away from the user's ear canal provides a separation point due to the fact that the over-the-ear portions (i.e., the left over-the-ear portion 208 and the right over-the-ear portion 202) interact with the pinnae (ear lobes) of the user, which causes the user to think of these sounds (i.e., from the left over-the-ear portion 208 and the right over-the-ear portion 202) as being farther away from the ear due to loudness and time-of-flight of the sounds (if the same sound is played though the inner-ear portions and the over-the-ear portions simultaneously). A typical listener will experience a more ambient, natural effect of the virtual environment that they are in due to the positioning of the inner-ear portions (i.e., the left inner-ear portion 206 and right inner-ear portion 204) and over-the-ear portions (i.e., the left over-the-ear portion 208 and the right over-the-ear portion 202) in the headphone speaker system 106/116. The positioning of the inner-ear portions and the over-the-ear portions will have a psychoacoustic effect due to the difference in distances of the inner-ear portions and the over-the-ear portions from the user's ear canal and user's ear drum. Further, the positioning of the inner-ear portions allows for a more natural effect for sounds in front of the user as they would in the real world. As the sounds from the inner-ear portions and the over-the-ear portions are not coming from exactly the same plane as in standard headphones, a user's brain interprets these sounds as two sources depending on the audio playback.

The left over-the-ear portion 208 may be electrically, physically, and movably connected to the left inner-ear portion 206 using a cable 212 (see FIGS. 2A-2C and 2F). Alternatively, a left hinge 242 (see FIG. 2D) may physically and movably connect the left over-the-ear portion 208 to the left inner-ear portion 206. The left hinge 242 may be made of plastic or metal. The cable 212 may include one or more flexible wires 236 that are bundled together within the cable 212 and that transmit one or more audio channels to the left inner-ear speaker 108. Cable 212 may be embedded in or around a malleable, shape retaining metal structure. This enables the left inner-ear portion 206 to be positioned as desired. In other words, the cable 212 may provide one or more audio channels to the left inner-ear portion 206 and may act as a structural support to keep the left inner-ear portion 206 attached to the left over-the-ear portion 208. The left over-the-ear portion 208 may also include a recessed area 250 (see FIG. 2F) for physically storing the left inner-ear portion 206.

Similarly, the right over-the-ear portion 202 may be electrically, physically, and movably connected to the right inner-ear portion 204 using a cable 214 (see FIGS. 2A-2C and 2E). Alternatively, a right hinge 240 (see FIG. 2D) may physically and movably connect the right over-the-ear portion 202 to the right inner-ear portion 204. The right hinge 240 may be made of plastic or metal. The cable 214 may include one or more flexible wires 232 that are bundled together within the cable 214 and that transmit one or more audio channels to the right inner-ear speaker 110. Cable 214 may be embedded in or around a malleable, shape retaining metal structure. This enables the right inner-ear portion 204 to be positioned as desired. In other words, the cable 214 may provide one or more audio channels to the right inner-ear portion 204 and may act as a structural support to keep the right inner-ear portion 204 attached to the right over-the-ear portion 202. The right over-the-ear portion 202 may also include a recessed area 252 (see FIG. 2E) for physically storing the right inner-ear portion 204.

FIGS. 2A-2F also illustrate a connector portion (sometimes referred to as a headband) 210 that physically connects the left over-the-ear portion 208 to the right over-the-ear portion 202. The connector portion 210 may include one or more flexible wires 234 that can be used to transmit audio channels to the different speakers within the headphone speaker system 106/116. Further, the connector portion 210 also acts as a supporting structure to keep the left over-the-ear portion 208 and the right over-the-ear portion 202 attached to each other. The connector portion 210 may be made of a hard piece of plastic (or metal) that allows a user of the headphone speaker system 106/116 to comfortably and securely wear the headphone speaker system 106/116 on the user's head.

Further, FIGS. 2A-2F illustrate a cable 216 that is connected to the headphone speaker system 106/116. The cable 216 may include one or more flexible wires 230 (that are bundled within the cable 216) that may be connected to an audio source 102. The audio signals received from the audio source 102 are routed by the one or more flexible wires 230 of the cable 216 to the different speakers within the headphone speaker system 106/116. The cable 216 may be of a USB connector type, a 3.5 mm connector, or any other type of connector that can connect to an audio source. Cable 216 may be embedded in or around a malleable, shape retaining metal structure.

Example 1—Processor 104 May be External to the Headphone Speaker System 106

In one example, the processor 104 may be external to the headphone speaker system 106. In this example, the audio source 102 provides one or more audio signals to the processor 104 and the processor 104 separates the one or more audio signals into a plurality of audio channels. The cable 216 receives the plurality of audio channels from the processor 104 via the one or more flexible wires 230 of the cable 216 that connect to the processor 104, and routes (via one or more flexible wires 230 of the cable 216) the plurality of different audio channels (for example, a left surround audio channel, a right surround audio channel, a left front audio channel, a right front audio channel, a left center audio channel, a right center audio channel, a left subwoofer audio channel, and a right subwoofer audio channel) to the left over-the-ear portion 208, the left inner-ear portion 206, the right inner-ear portion 204, and the right over-the-ear portion 202. For example, the left inner-ear portion 206 may receive the left front audio channel, the right inner-ear portion 204 may receive the right front audio channel, the left over-the-ear portion 208 may receive the left surround audio channel, and the right over-the-ear portion 202 may receive the right surround audio channel. Further, the left inner-ear portion 206 and the right inner-ear portion 204 may also receive the left center audio channel and the right center audio channel, respectively, and the left over-the-ear portion 208 and right over-the-ear portion 202 may also receive a left subwoofer audio channel and a right subwoofer audio channel, respectively.

The cable 216 may include one or more flexible wires 230 that provide the plurality of audio channels to the plurality of speakers (i.e., the left-inner-ear speaker 108, the right inner-ear speaker 110, the left over-the-ear speaker 112, and the right over-the-ear speaker 114). These flexible wires 230 may be bundled within the cable 216 and each of these flexible wires 230 may provide a separate audio channel to a corresponding one of the plurality of speakers. It should be understood that each wire 230 in the cable 216 can provide one or more audio channels to one or more speakers within the headphone speaker system 106/116. For example, as illustrated in FIGS. 2A-2F, the cable 216 may be connected to the left over-the-ear portion 208 and may provide one or more audio channels to the left-over-the ear speaker 112 (which is housed within the left over-the-ear portion 208) based on this connection. Although cable 216 is illustrated in FIGS. 2A-2F as being connected to the left over-the-ear portion 208, it should be understood that, in the alternative, the cable 216 may be connected to the right over-the-ear portion 202.

Further, the cable 216 may provide one or more audio channels to the left inner-ear speaker 108 (which is housed within the left inner-ear portion 206) via a connection with one or more flexible wires 236 (within the cable 212) that connect to the left inner-ear speaker 108. The connector portion 210 may include one or more flexible wires 234 that are connected to one or more flexible wires 230 of the cable 216 and to the right over-the ear speaker 114 (which is housed within the right over-the-ear portion 202). The one more flexible wires 234 within the connector portion 210 may route one or more audio channels from the cable 216 to the right over-the ear speaker 114 (which is housed within the right over-the-ear portion 202). Additionally, the one or more flexible wires 234 within the connector portion 210 may also connect to one or more flexible wires 232 of the cable 214 so that the cable 216 can route one or more audio channels via the one or more flexible wires 234 within the connector portion 210 and the one or more flexible wires 232 within the cable 214 to the right inner-ear speaker 110 (which is housed within the right inner-ear portion 204).

After the plurality of audio channels are routed to the inner-ear and over-the-ear speakers (that are housed within the inner-ear and over-the-ear portions illustrated in FIGS. 2A-2F), one or more drivers 109, 111, 113, and 115 within the inner-ear and over-the-ear speakers convert the received audio channels (for example, a left surround audio channel, a right surround audio channel, a left front audio channel, a right front audio channel, a left center audio channel, a right center audio channel, a left subwoofer audio channel, and a right subwoofer audio channel) into one or more audible sounds. For example, the left over-the-ear speaker 112 generates a left surround sound by converting the left surround audio channel into the left surround sound, the right over-the-ear speaker 114 generates a right surround sound by converting the right surround audio channel into the right surround sound, the left inner-ear speaker 108 generates a left front sound by converting the left front audio channel into the left front sound, and the right inner-ear speaker 110 generates a right front sound by converting the right front audio channel into the right front sound. Further, for example, the left inner-ear speaker 108 generates a left center sound by converting the left center audio channel into the left center sound, the right inner-ear speaker 110 generates a right center sound by converting the right center audio channel into the right center sound, the left over-the-ear speaker 112 generates a left subwoofer sound by converting the left subwoofer audio channel, and the right over-the-ear speaker 114 generates a right subwoofer sound by converting the right subwoofer audio channel.

As a result, the user of the headphone speaker system 106 hears a left surround sound, a right surround sound, a left subwoofer sound, and/or a right subwoofer sound via the left over-the-ear portion 208 and the right over-the-ear portion 202 and hears a left front sound, a right front sound, a left center sound, and/or a right center sound via the left inner-ear portion 206 and the right inner-ear portion 204. The left inner-ear portion 206 (including the left inner-ear speaker 108) and the right inner-ear portion 204 (including the right inner-ear speaker 110) include openings to allow the sound from the over-the-ear portions/speakers to pass therethrough.

Example 2—Processor 104 May be Inside the Headphone Speaker System 116

Alternatively, in another example, the processor 104 may be inside the headphone speaker system 116 (for example, within the cable 216, or any other portion of the headphone speaker system 116). In such a case, the cable 216 may receive an audio signal from an audio source 102 and may provide the audio signal to the internal processor 104. Once the processor 104 separates the audio signal into a plurality of audio channels, processor 104 may route the plurality of audio channels to the plurality of speakers via one or more flexible wires that connect the processor 104 and the plurality of speakers.

Although FIGS. 2A-2F illustrate a cable 216, the cable 216 is optional. In other words, the headphone speaker system 106/116 may be wirelessly connected to receive the audio signal or the different audio channels. For example, the headphone speaker system 106/116 may include a transceiver (not shown) that can receive and transmit wireless signals. Examples of wireless signals include radio signals, infrared signals, Bluetooth signals, or any other wireless signals that can include an audio signal or an audio channel. In a case where the headphone speaker system 116 in FIGS. 2A-2F includes the processor 104 (the processor 104 may be located in any portion of the headphone speaker system 116 in FIGS. 2A-2F), the transceiver of the headphone speaker system 116 may communicate wirelessly with an audio source (see audio source 102 in FIG. 1B) to wirelessly receive an audio signal from the audio source 102 and may forward the received audio signal to the processor 104 via a wired connection between the transceiver and the processor 104. Once the audio signal is received by the processor 104, the processor 104 separates the received audio signal into different audio channels. The processor 104 may be connected to one or more flexible wires that route the different audio channels to the different speakers within the headphone speaker system 116.

Alternatively, in a case where the headphone speaker system 106 in FIGS. 2A-2F does not include the processor 104 (see FIG. 1A), the headphone speaker system 106 may wirelessly receive the different audio channels from the processor 104 (which may be external to the headphone speaker system 106 in this case and which may be connected to an audio source 102 via a wired or wireless connection). For example, the headphone speaker system 106 may include a transceiver (not shown) that can receive and transmit wireless signals from and to another transceiver (not shown) that may be connected (for example, via a wired connection) to the external processor 104. When the different audio channels are received wirelessly by transceiver of the headphone speaker system 106 from an external processor 104, the transceiver of the headphone speaker system 106 may route (via, for example, another processor (not shown)) the different audio channels via one or more flexible wires to the different speakers within the headphone speaker system 106.

Further, although FIGS. 2A, 2B, and 2C illustrate cables 212 and 214, the cables 212 and 214 are optional. The inner-ear portions 204 and 206 may be wirelessly connected such that they wirelessly receive the audio channels from the processor 104. For example, the headphone speaker system 106/116 may include a transceiver (not shown) that may transmit audio channels to a transceiver (not shown) within the inner-ear portions 204 and 206. In some embodiments, the inner-ear portions 204 and 206 that are connected to the over-the-ear portions 202 and 208 using hinges 240 and 242 (as illustrated in FIG. 2D) may receive the audio channels wirelessly.

The headphone speaker system 106/116 in FIGS. 2A-2F may further include a microphone 244 for chat capability. Chat signals may be received by the headphone speaker system 106/116 either wirelessly or via the cable 216 and may be routed to the left inner-ear portion 206 (for example, the left inner-ear speaker 108) and to the right inner-ear portion 204 (for example, the right inner-ear speaker 110) via one or more flexible wires within the headphone speaker system 106/116. The user's voice may be routed externally via the microphone 244 attached to the headphone speaker system 106/116. The left and right inner-ear portions 206 and 204 may be connected to the left and right over-the-ear portions 208 and 202 via Bluetooth connectivity. Additionally, left and right inner-ear portions 206 and 204 and the left and right over-the-ear portions 208 and 202 may be connected to an external device via Bluetooth.

Further, the headphone speaker system 106/116 may include a rechargeable (for example, a small li-ion battery that may have a connection point to allow for recharging capability) or disposable battery 116 (see FIGS. 1A and 1B) within the headphone speaker system 106/116 that provides power for the inner-ear speakers (i.e., the left inner-ear speaker 108 and right inner-ear speaker 110) and over-the-ear speakers (i.e., the left over-the-ear speaker 112 and the right over-the-ear speaker 114). In case the processor 104 is within the headphone speaker system (see embodiment in FIG. 1B), the rechargeable or disposable battery 116 may also provide power for the processor 104. Alternatively, any other source of power (for example, solar) may be included within the headphone speaker system 106/116.

Figure 3:
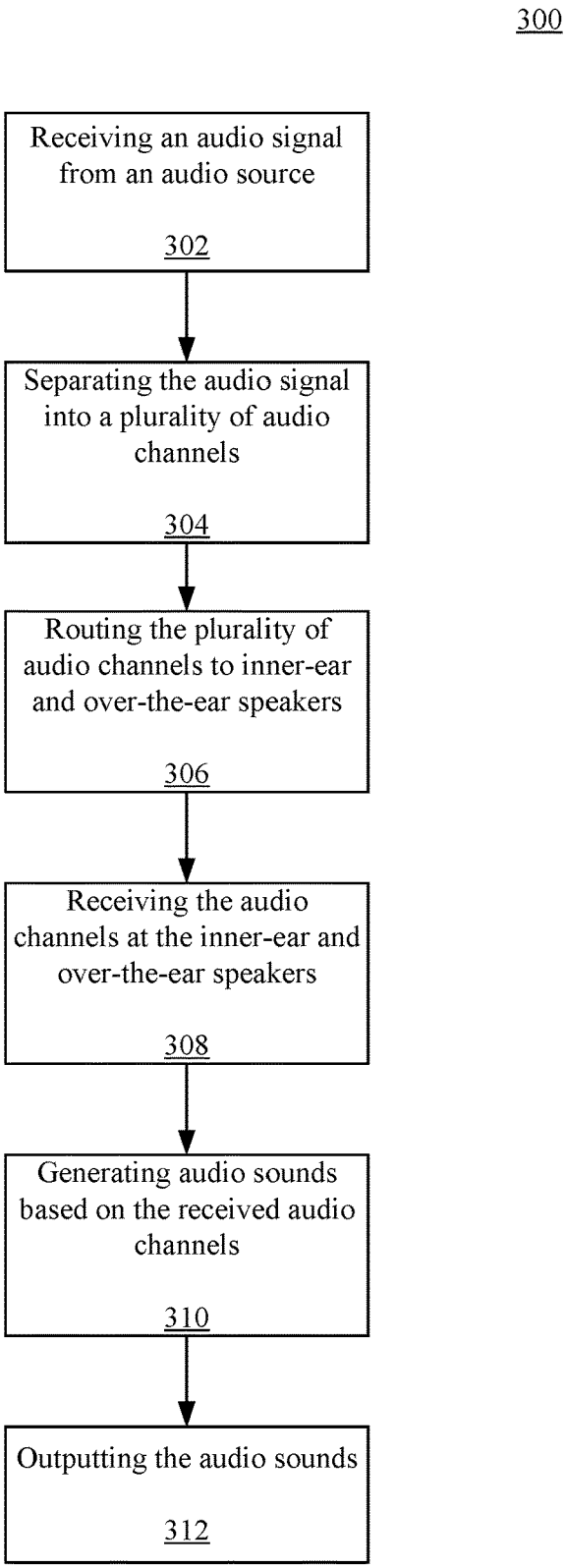
FIG. 3 illustrates an exemplary method of receiving audio channels and outputting audio sounds.

FIG. 3 illustrates an example flowchart 300 describing a method of receiving audio channels by the inner-ear and over-the-ear speakers, and outputting audio sounds (generated based on the audio channels) via the inner-ear and over-the-ear speakers. In Step 302, a processor 104 (see also FIGS. 1A and 1B) receives an audio signal (or a plurality of audio signals) from an audio source 102 (see also FIGS. 1A and 1B). The audio signal may include one or more of the following audio channels: a left surround audio channel, a right surround audio channel, a left front audio channel, a right front audio channel, a left center audio channel, a right center audio channel, a left subwoofer audio channel, and a right subwoofer audio channel. The audio channels received by the processor 104 are not limited to the ones mentioned above, and can include any other audio channel.

Once the processor 104 receives the audio signal, the processor 104, in Step 304, separates the audio signals into a plurality of different audio channels (or components). For example, when the processor 104 receives an audio signal, the processor 104 may separate the audio signal into the following audio channels: a left surround audio channel, a right surround audio channel, a left front audio channel, a right front audio channel, a left center audio channel, a right center audio channel, a left subwoofer audio channel, and a right subwoofer audio channel.

Once the audio channels are separated by the processor 104, these separated audio channels are routed/transmitted to the left inner-ear speaker 108, right inner-ear speaker 110, left over-the-ear speaker 112, and right over-the-ear speaker 114 in Step 306 (see also FIGS. 1A and 1B). In Step 308, the inner-ear speakers (which are configured to be positioned at least partially within a user's ear canal) and over-the-ear speakers (which are configured to be positioned outside the user's ear canal) receive the plurality of audio channels that are routed/transmitted from the processor 104. For example, the left inner-ear speaker 108 may receive the left front audio channel, the right inner-ear speaker 110 may receive the right front audio channel, the left over-the-ear speaker 112 may receive the left surround audio channel, and the right over-the-ear speaker 114 may receive the right surround audio channel. Further, the left inner-ear speaker 108 and the right inner-ear speaker 110 may also receive the left center audio channel and the right center audio channel, respectively, and the left over-the-ear speaker 112 and right over-the-ear speaker 114 may also receive a left subwoofer audio channel and a right subwoofer audio channel, respectively.

In Step 310 the inner-ear and over-the-ear speakers generate audio sounds based on the received audio channels. For example, each of the speakers (i.e., the left inner-ear speaker 108, right inner-ear speaker 110, left over-the-ear speaker 112, and right over-the-ear speaker 114) may include one or more drivers 109, 111, 113, and 115 that convert the received audio channels (for example, a left surround audio channel, a right surround audio channel, a left front audio channel, a right front audio channel, a left center audio channel, a right center audio channel, a left subwoofer audio channel, and a right subwoofer audio channel) into one or more audible sounds. For example, the left over-the-ear speaker 112 generates a left surround sound by converting the left surround audio channel into the left surround sound, the right over-the-ear speaker 114 generates a right surround sound by converting the right surround audio channel into the right surround sound, the left inner-ear speaker 108 generates a left front sound by converting the left front audio channel into the left front sound, and the right inner-ear speaker 110 generates a right front sound by converting the right front audio channel into the right front sound. Further, for example, the left inner-ear speaker 108 generates a left center sound by converting the left center audio channel into the left center sound, the right inner-ear speaker 110 generates a right center sound by converting the right center audio channel into the right center sound, the left over-the-ear speaker 112 generates a left subwoofer sound by converting the left subwoofer audio channel, and the right over-the-ear speaker 114 generates a right subwoofer sound by converting the right subwoofer audio channel.

In Step 312, the different sounds described above in Step 310 are output to the user's ears via each of the speakers (i.e., the left inner-ear speaker 108, right inner-ear speaker 110, left over-the-ear speaker 112, and right over-the-ear speaker 114). In other words, a left surround sound, a right surround sound, a left subwoofer sound, and/or a right subwoofer sound is output to the user's ear via the left over-the-ear speaker 112 and the right over-the-ear speaker 114 (where the left over-the-ear speaker 112 and the right over-the-ear speaker 114 are configured to be positioned outside the user's left ear canal and right ear canal, respectively) and a left front sound, a right front sound, a left center sound, and/or a right center sound are output to the user via the left inner-ear speaker 108 and the right inner-ear speaker 110 (where the left inner-ear speaker 108 and the right inner-ear speaker 110 are configured to be positioned at least partially within the user's left ear canal and right ear canal, respectively).

Although the present invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the scope of the appended claims. For example, it is to be understood that the present invention contemplates that, to the extent possible, one or more features of any embodiment may be combined with one or more features of any other embodiment.

The present techniques will be better understood with reference to the following enumerated embodiments:

1. A headphone speaker system comprising: a left over-the-ear speaker configured to receive a left surround audio channel of an audio signal from one or more surround sound processors and configured to be positioned outside a left ear canal of a user; a right over-the-ear speaker configured to receive a right surround audio channel of the audio signal from the one or more surround sound processors and configured to be positioned outside a right ear canal of the user; a left inner-ear speaker configured to receive a left front audio channel of the audio signal from the one or more surround sound processors and configured to be positioned at least partially within the left ear canal of the user; and a right inner-ear speaker configured to receive a right front audio channel of the audio signal from the one or more surround sound processors and configured to be positioned at least partially within the right ear canal of the user.

2. The headphone speaker system of embodiment 1, wherein the left over-the-ear speaker is configured to generate a left surround sound based on the left surround audio channel, the right over-the-ear speaker is configured to generate a right surround sound based on the right surround audio channel, the left inner-ear speaker is configured to generate a left front sound based on the left front audio channel, and the right inner-ear speaker is configured to generate a right front sound based on the right front audio channel.

3. The headphone speaker system of any of embodiments 1 and 2, wherein the left inner-ear speaker is configured to receive a left center audio channel of the audio signal from the one or more surround sound processors and configured to generate a left center sound based on the left center audio channel, and the right inner-ear speaker is configured to receive a right center audio channel of the audio signal from the one or more surround sound processors and configured to generate a right center sound based on the right center audio channel.

4. The headphone speaker system of any of embodiments 1-3, wherein the left over-the-ear speaker is configured to receive a left subwoofer audio channel of the audio signal from the one or more surround sound processors and configured to generate a left subwoofer sound based on the left subwoofer audio channel, and the right over-the-ear speaker is configured to receive a right subwoofer audio channel of the audio signal from the one or more surround sound processors and configured to generate a right subwoofer sound based on the right subwoofer audio channel.

5. The headphone speaker system of any of embodiments 1-4, further comprising: a left cable that movably connects a left inner-ear portion of the headphone speaker system that houses the left inner-ear speaker to a left over-the-ear portion of the headphone speaker system that houses the left over-the-ear speaker; and a right cable that movably connects a right inner-ear portion of the headphone speaker system that houses the right inner-ear speaker to a right over-the-ear portion of the headphone speaker system that houses the right over-the-ear speaker.

6. The headphone speaker system of any of embodiments 1-5, further comprising: a left hinge that movably connects a left inner-ear portion of the headphone speaker system that houses the left inner-ear speaker to a left over-the-ear portion of the headphone speaker system that houses the left over-the-ear speaker; and a right hinge that movably connects a right inner-ear portion of the headphone speaker system that houses the right inner-ear speaker to a right over-the-ear portion of the headphone speaker system that houses the right over-the-ear speaker.

7. The headphone speaker system of any of embodiments 1-6, wherein the left inner-ear speaker has at least one opening that allows sound from the left over-the-ear speaker to pass therethrough, and the right inner-ear speaker has at least one opening that allows sound from the right over-the-ear speaker to pass therethrough.

8. The headphone speaker system of any of embodiments 1-7, further comprising: the one or more surround sound processors, wherein the one or more surround sound processors is programmed to: receive the audio signal from an external audio source, separate the audio signal into the left surround audio channel, the right surround audio channel, the left front audio channel, and the right front audio channel, and output the left surround audio channel to the left over-the-ear speaker, the right surround audio channel to the right over-the-ear speaker, the left front audio channel to the left inner-ear speaker, and the right front audio channel to the right inner-ear speaker.

9. The headphone speaker system of any of embodiments 1-8, wherein the one or more surround sound processors is programmed to delay the output of the left front audio channel and the right front audio channel by a predetermined amount such that the user's ear simultaneously receives a left surround sound based on the left surround audio channel, a right surround sound based on the right surround audio channel, a left front sound based on the left front audio channel, and a right front sound based on the right front audio channel.

10. The headphone speaker system of any of embodiments 1-9, wherein the predetermined amount is based on distances between the left over-the-ear speaker and the left inner-ear speaker and between the right over-the-ear speaker and the right inner-ear speaker.

11. The headphone speaker system of any of embodiments 1-10, wherein the one or more surround sound processors is programmed to adjust gain for multiple frequencies of the audio signal based on a user input.

12. The headphone speaker system of any of embodiments 1-11, wherein the left over-the-ear speaker is positioned such that the left surround sound is aimed directly towards the left ear canal of the user, the right over-the-ear speaker is positioned such that the right surround sound is aimed directly towards the right ear canal of the user, the left inner-ear speaker is positioned such that the left front sound is aimed directly towards the left ear canal of the user, and the right inner-ear speaker is positioned such that the right front sound is aimed directly towards the right ear canal of the user.

13. The headphone speaker system of any of embodiments 1-12, wherein the one or more surround sound processors is programmed to receive the audio signal from an external audio source via a wired or wireless connection.

14. The headphone speaker system of any of embodiments 1-13, further comprising: a rechargeable battery configured to power the one or more surround sound processors, the left over-the-ear speaker, the right over-the-ear speaker, the left inner-ear speaker, and the right inner-ear speaker.

15. The headphone speaker system of any of embodiments 1-14, wherein the left over-the-ear speaker includes at least one driver that is configured to convert the left surround audio channel to a left surround sound, the right over-the-ear speaker includes at least one driver that is configured to convert the right surround audio channel to a right surround sound, the left inner-ear speaker includes at least one driver that is configured to convert the left front audio channel to a left front sound, and the right inner-ear speaker includes at least one driver that is configured to convert the right front audio channel to a right front sound.

16. The headphone speaker system of any of embodiments 1-15, wherein the one or more surround sound processors is connected to the left over-the-ear speaker, the right over-the-ear speaker, the left inner-ear speaker, and the right inner-ear speaker via one or more wires.

17. The headphone speaker system of any of embodiments 1-16, wherein the one or more surround sound processors is wirelessly connected to the left over-the-ear speaker, the right over-the-ear speaker, the left inner-ear speaker, and the right inner-ear speaker.

18. The headphone speaker system of any of embodiments 1-17, further comprising: a connector portion that physically connects a left over-the-ear portion of the headphone speaker system that houses the left over-the-ear speaker to a right over-the-ear portion of the headphone speaker system that houses the right over-the-ear speaker.

19. A method of receiving audio channels of an audio signal by a headphone speaker system, the method comprising: receiving, by a left over-the-ear speaker of the headphone speaker system, a left surround audio channel of the audio signal from one or more surround sound processors, the left over-the-ear speaker being configured to be positioned outside a left ear canal of a user; receiving, by a right over-the-ear speaker of the headphone speaker system, a right surround audio channel of the audio signal from the one or more surround sound processors, the right over-the-ear speaker being configured to be positioned outside a right ear canal of the user; receiving, by a left inner-ear speaker of the headphone speaker system, a left front audio channel of the audio signal from the one or more surround sound processors, the left inner-ear speaker being configured to be positioned at least partially within the left ear canal of the user; and receiving, by a right inner-ear speaker of the headphone speaker system, a right front audio channel of the audio signal from the one or more surround sound processors, the right inner-ear speaker being configured to be positioned at least partially within the right ear canal of the user.

20. The method of embodiment 19, further comprising: generating, by the left over-the-ear speaker, a left surround sound based on the received left surround audio channel; generating, by the right over-the-ear speaker, a right surround sound based on the received right surround audio channel; generating, by the left inner-ear speaker, a left front sound based on the received left front audio channel; and generating, by the right inner-ear speaker, a right front sound based on the received right front audio channel.

What is claimed is:

1. A headphone speaker system comprising:

a left over-the-ear speaker configured to receive a left surround audio channel of an audio signal from one or more surround sound processors and configured to be positioned outside a left ear canal of a user;

a right over-the-ear speaker configured to receive a right surround audio channel of the audio signal from the one or more surround sound processors and configured to be positioned outside a right ear canal of the user;

a left inner-ear speaker configured to receive a left front audio channel of the audio signal from the one or more surround sound processors and configured to be positioned at least partially within the left ear canal of the user; and a right inner-ear speaker configured to receive a right front audio channel of the audio signal from the one or more surround sound processors and configured to be positioned at least partially within the right ear canal of the user.

2. The headphone speaker system of claim 1, wherein the left over-the-ear speaker is configured to generate a left surround sound based on the left surround audio channel, the right over-the-ear speaker is configured to generate a right surround sound based on the right surround audio channel, the left inner-ear speaker is configured to generate a left front sound based on the left front audio channel, and the right inner-ear speaker is configured to generate a right front sound based on the right front audio channel.

3. The headphone speaker system of claim 2, wherein the left over-the-ear speaker is positioned such that the left surround sound is aimed directly towards the left ear canal of the user, the right over-the-ear speaker is positioned such that the right surround sound is aimed directly towards the right ear canal of the user, the left inner-ear speaker is positioned such that the left front sound is aimed directly towards the left ear canal of the user, and the right inner-ear speaker is positioned such that the right front sound is aimed directly towards the right ear canal of the user.

4. The headphone speaker system of claim 1, wherein the left inner-ear speaker is configured to receive a left center audio channel of the audio signal from the one or more surround sound processors and configured to generate a left center sound based on the left center audio channel, and the right inner-ear speaker is configured to receive a right center audio channel of the audio signal from the one or more surround sound processors and configured to generate a right center sound based on the right center audio channel.

5. The headphone speaker system of claim 1, wherein the left over-the-ear speaker is configured to receive a left subwoofer audio channel of the audio signal from the one or more surround sound processors and configured to generate a left subwoofer sound based on the left subwoofer audio channel, and the right over-the-ear speaker is configured to receive a right subwoofer audio channel of the audio signal from the one or more surround sound processors and configured to generate a right subwoofer sound based on the right subwoofer audio channel.

6. The headphone speaker system of claim 1, further comprising:

a left cable that movably connects a left inner-ear portion of the headphone speaker system that houses the left inner-ear speaker to a left over-the-ear portion of the headphone speaker system that houses the left over-the-ear speaker; and a right cable that movably connects a right inner-ear portion of the headphone speaker system that houses the right inner-ear speaker to a right over-the-ear portion of the headphone speaker system that houses the right over-the-ear speaker.

7. The headphone speaker system of claim 1, further comprising:

a left hinge that movably connects a left inner-ear portion of the headphone speaker system that houses the left inner-ear speaker to a left over-the-ear portion of the headphone speaker system that houses the left over-the-ear speaker; and a right hinge that movably connects a right inner-ear portion of the headphone speaker system that houses the right inner-ear speaker to a right over-the-ear portion of the headphone speaker system that houses the right over-the-ear speaker.

8. The headphone speaker system of claim 1, wherein the left inner-ear speaker has at least one opening that allows sound from the left over-the-ear speaker to pass therethrough, and the right inner-ear speaker has at least one opening that allows sound from the right over-the-ear speaker to pass therethrough.

9. The headphone speaker system of claim 1, further comprising:

the one or more surround sound processors, wherein the one or more surround sound processors is programmed to:

receive the audio signal from an external audio source, separate the audio signal into the left surround audio channel, the right surround audio channel, the left front audio channel, and the right front audio channel, and output the left surround audio channel to the left over-the-ear speaker, the right surround audio channel to the right over-the-ear speaker, the left front audio channel to the left inner-ear speaker, and the right front audio channel to the right inner-ear speaker.

10. The headphone speaker system of claim 9, wherein the one or more surround sound processors is programmed to delay the output of the left front audio channel and the right front audio channel by a predetermined amount such that the user's ear simultaneously receives a left surround sound based on the left surround audio channel, a right surround sound based on the right surround audio channel, a left front sound based on the left front audio channel, and a right front sound based on the right front audio channel.

11. The headphone speaker system of claim 10, wherein the predetermined amount is based on distances between the left over-the-ear speaker and the left inner-ear speaker and between the right over-the-ear speaker and the right inner-ear speaker.

12. The headphone speaker system of claim 1, wherein the one or more surround sound processors is programmed to adjust gain for multiple frequencies of the audio signal based on a user input.

13. The headphone speaker system of claim 1, wherein the one or more surround sound processors is programmed to receive the audio signal from an external audio source via a wired or wireless connection.

14. The headphone speaker system of claim 1, further comprising:

a rechargeable battery configured to power the one or more surround sound processors, the left over-the-ear speaker, the right over-the-ear speaker, the left inner-ear speaker, and the right inner-ear speaker.

15. The headphone speaker system of claim 1, wherein the left over-the-ear speaker includes at least one driver that is configured to convert the left surround audio channel to a left surround sound, the right over-the-ear speaker includes at least one driver that is configured to convert the right surround audio channel to a right surround sound, the left inner-ear speaker includes at least one driver that is configured to convert the left front audio channel to a left front sound, and the right inner-ear speaker includes at least one driver that is configured to convert the right front audio channel to a right front sound.

16. The headphone speaker system of claim 1, wherein the one or more surround sound processors is connected to the left over-the-ear speaker, the right over-the-ear speaker, the left inner-ear speaker, and the right inner-ear speaker via one or more wires.

17. The headphone speaker system of claim 1, wherein the one or more surround sound processors is wirelessly connected to the left over-the-ear speaker, the right over-the-ear speaker, the left inner-ear speaker, and the right inner-ear speaker.

18. The headphone speaker system of claim 1, further comprising:

a connector portion that physically connects a left over-the-ear portion of the headphone speaker system that houses the left over-the-ear speaker to a right over-the-ear portion of the headphone speaker system that houses the right over-the-ear speaker.

19. A headphone speaker system comprising:

one or more surround sound processors configured to receive an audio signal;

a left over-the-ear speaker configured to receive a left surround audio channel of the audio signal from the one or more surround sound processors and configured to be positioned outside a left ear canal of a user;

a right over-the-ear speaker configured to receive a right surround audio channel of the audio signal from the one or more surround sound processors and configured to be positioned outside a right ear canal of the user;

a left inner-ear speaker configured to receive a left front audio channel of the audio signal from the one or more surround sound processors and configured to be positioned at least partially within the left ear canal of the user; and a right inner-ear speaker configured to receive a right front audio channel of the audio signal from the one or more surround sound processors and configured to be positioned at least partially within the right ear canal of the user.

20. The headphone speaker system of claim 19, wherein the surround sound processor is programmed to:

separate the audio signal into the left surround audio channel, the right surround audio channel, the left front audio channel, and the right front audio channel, and output the left surround audio channel to the left over-the-ear speaker, the right surround audio channel to the right over-the-ear speaker, the left front audio channel to the left inner-ear speaker, and the right front audio channel to the right inner-ear speaker.

21. The headphone speaker system of claim 19, wherein the one or more surround sound processors is connected to the left over-the-ear speaker, the right over-the-ear speaker, the left inner-ear speaker, and the right inner-ear speaker via one or more wires.

22. The headphone speaker system of claim 19, wherein the one or more surround sound processors is wirelessly connected to the left over-the-ear speaker, the right over-the-ear speaker, the left inner-ear speaker, and the right inner-ear speaker.

23. The headphone speaker system of claim 19, further comprising:

a left cable that movably connects a left inner-ear portion of the headphone speaker system that houses the left inner-ear speaker to a left over-the-ear portion of the headphone speaker system that houses the left over-the-ear speaker; and a right cable that movably connects a right inner-ear portion of the headphone speaker system that houses the right inner-ear speaker to a right over-the-ear portion of the headphone speaker system that houses the right over-the-ear speaker.

24. The headphone speaker system of claim 19, further comprising:

a left hinge that movably connects a left inner-ear portion of the headphone speaker system that houses the left inner-ear speaker to a left over-the-ear portion of the headphone speaker system that houses the left over-the-ear speaker; and a right hinge that movably connects a right inner-ear portion of the headphone speaker system that houses the right inner-ear speaker to a right over-the-ear portion of the headphone speaker system that houses the right over-the-ear speaker.

25. The headphone speaker system of claim 19, further comprising:

a connector portion that physically connects a left over-the-ear portion of the headphone speaker system that houses the left over-the-ear speaker to a right over-the-ear portion of the headphone speaker system that houses the right over-the-ear speaker.

26. A method of receiving audio channels of an audio signal by a headphone speaker system, the method comprising:

receiving, by a left over-the-ear speaker of the headphone speaker system, a left surround audio channel of the audio signal from one or more surround sound processors, the left over-the-ear speaker being configured to be positioned outside a left ear canal of a user;

receiving, by a right over-the-ear speaker of the headphone speaker system, a right surround audio channel of the audio signal from the one or more surround sound processors, the right over-the-ear speaker being configured to be positioned outside a right ear canal of the user;

receiving, by a left inner-ear speaker of the headphone speaker system, a left front audio channel of the audio signal from the one or more surround sound processors, the left inner-ear speaker being configured to be positioned at least partially within the left ear canal of the user; and receiving, by a right inner-ear speaker of the headphone speaker system, a right front audio channel of the audio signal from the one or more surround sound processors, the right inner-ear speaker being configured to be positioned at least partially within the right ear canal of the user.

27. The method of claim 26, further comprising:

generating, by the left over-the-ear speaker, a left surround sound based on the received left surround audio channel;

generating, by the right over-the-ear speaker, a right surround sound based on the received right surround audio channel;

generating, by the left inner-ear speaker, a left front sound based on the received left front audio channel; and generating, by the right inner-ear speaker, a right front sound based on the received right front audio channel.

* * * * *